US009740138B2

(12) United States Patent
Tsurumi et al.

(10) Patent No.: US 9,740,138 B2
(45) Date of Patent: Aug. 22, 2017

(54) ELECTROSTATIC CHARGE IMAGE DEVELOPING CARRIER, ELECTROSTATIC CHARGE IMAGE DEVELOPER, AND DEVELOPER CARTRIDGE

(71) Applicant: FUJI XEROX CO., LTD., Tokyo (JP)

(72) Inventors: Yosuke Tsurumi, Kanagawa (JP); Koji Sasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/097,736

(22) Filed: Apr. 13, 2016

(65) Prior Publication Data

US 2017/0184997 A1 Jun. 29, 2017

(30) Foreign Application Priority Data

Dec. 25, 2015 (JP) ..... 2015-254889

(51) Int. Cl.
*G03G 9/113* (2006.01)
*G03G 15/08* (2006.01)

(52) U.S. Cl.
CPC ..... *G03G 15/0808* (2013.01)

(58) Field of Classification Search
CPC ..... G03G 9/1133
See application file for complete search history.

(56) References Cited

U.S. PATENT DOCUMENTS 6,010,812 A * 1/2000 Barbetta ..... G03G 9/1133 430/111.35
8,921,023 B2 * 12/2014 Baba ..... G03G 9/107 430/111.32
2012/0129087 A1 * 5/2012 Iwami ..... G03G 9/107 430/106.2
2013/0171559 A1 * 7/2013 Nakamura ..... G03G 9/0832 430/111.32

FOREIGN PATENT DOCUMENTS

| | | | |
|---|---|---|---|
| JP | 2005-292717 | A | 10/2005 |
| JP | 2012-058637 | A | 3/2012 |
| JP | 2015-004787 | A | 1/2015 |

* cited by examiner

*Primary Examiner* — Hoa V Le
(74) *Attorney, Agent, or Firm* — Oliff PLC

(57) ABSTRACT

An electrostatic charge image developing carrier includes magnetic particles and a resin coating layer that is coated on surfaces of the magnetic particles and contains a coating resin having a structural unit represented by the following Formula (NA):

(NA)

wherein $R^1$ and $R^2$ each independently represents a hydrogen atom or an alkyl group having 1 to 4 carbon atoms, provided that at least one of $R^1$ and $R^2$ represents an alkyl group having 1 to 4 carbon atoms, $R^1$ and $R^2$ do not represent a methyl group at the same time, and $R^1$ and $R^2$ do not represent an ethyl group at the same time; $R^3$ represents an alkylene group having 1 to 3 carbon atoms; $R^4$ represents a hydrogen atom or a methyl group; and $L^1$ represents —C(=O)—O— or —C=(O)—NH—.

9 Claims, 2 Drawing Sheets

ELECTROSTATIC CHARGE IMAGE DEVELOPING CARRIER, ELECTROSTATIC CHARGE IMAGE DEVELOPER, AND DEVELOPER CARTRIDGE

CROSS-REFERENCE TO RELATED APPLICATIONS

This application is based on and claims priority under 35 USC 119 from Japanese Patent Application No. 2015-254889 filed Dec. 25, 2015.

BACKGROUND

1. Technical Field

The present invention relates to an electrostatic charge image developing carrier, an electrostatic charge image developer, and a developer cartridge.

2. Related Art

A method of visualizing image information through an electrostatic charge image, such as electrophotography, is currently used in various fields. In electrophotography, the image information is formed on a surface of an image holding member (photoreceptor) as an electrostatic charge image through charging and exposure processes, a toner image is developed on the surface of the photoreceptor using a developer containing a toner, and this toner image is visualized as an image through a transfer process of transferring the toner image to a recording medium such as a sheet and a fixing process of fixing the toner image onto a surface of the recording medium.

An electrostatic charge image developer used in electrophotography described above is largely divided into a single-component developer including only a toner and a two-component developer obtained by mixing a carrier with a toner.

SUMMARY

According to an aspect of the invention, there is provided an electrostatic charge image developing carrier including:

magnetic particles; and a resin coating layer that is coated on surfaces of the magnetic particles and contains a coating resin having a structural unit represented by the following Formula (NA):

(NA)

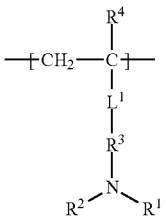

wherein $R^1$ and $R^2$ each independently represents a hydrogen atom or an alkyl group having 1 to 4 carbon atoms, provided that at least one of $R^1$ and $R^2$ represents an alkyl group having 1 to 4 carbon atoms, $R^1$ and $R^2$ do not represent a methyl group at the same time, and $R^1$ and $R^2$ do not represent an ethyl group at the same time; $R^3$ represents an alkylene group having 1 to 3 carbon atoms; $R^4$ represents a hydrogen atom or a methyl group; and $L^1$ represents —C(=O)—O— or —C=(O)—NH—.

BRIEF DESCRIPTION OF THE DRAWINGS

Exemplary embodiments of the present invention will be described in detail based on the following figures, wherein.

DETAILED DESCRIPTION

Figure 1:
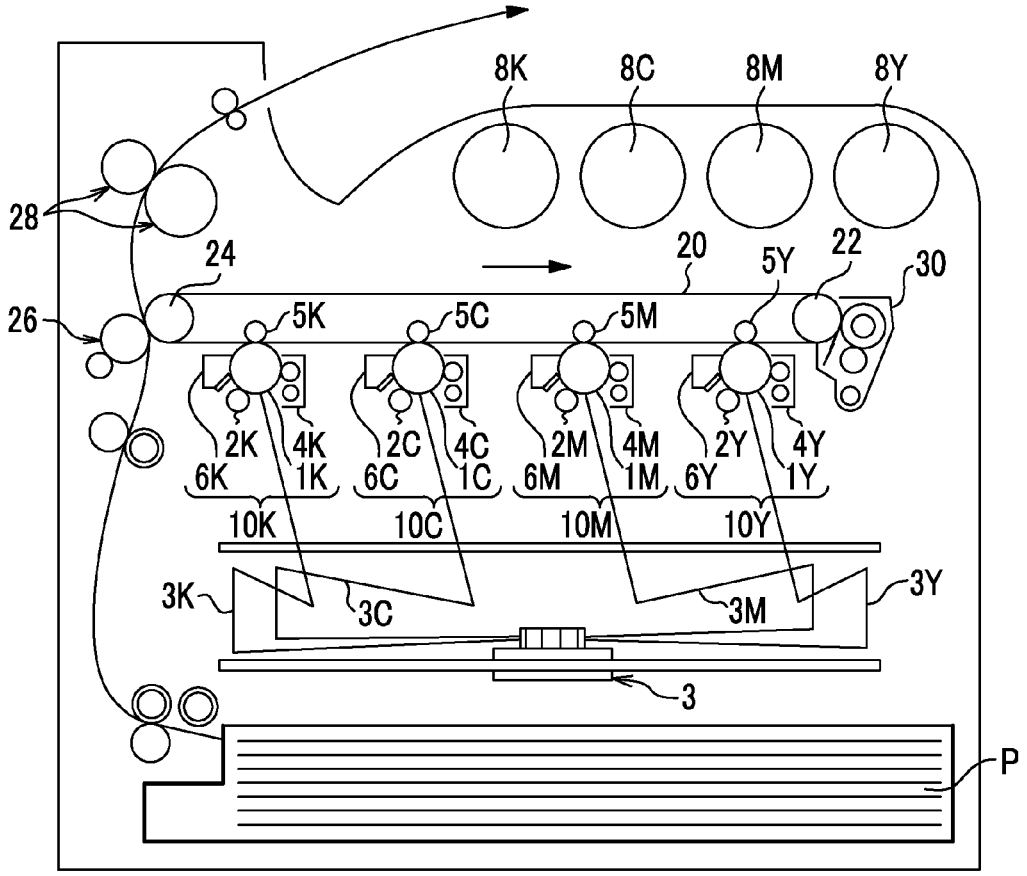
FIG. 1 is a schematic configuration diagram showing an example of an image forming apparatus according to the exemplary embodiment.

Hereinafter, exemplary embodiments which are examples of the invention will be described in detail.

Electrostatic Charge Image Developing Carrier

An electrostatic charge image developing carrier according to the exemplary embodiment (hereinafter, also simply referred to as a "carrier") includes magnetic particles and a resin coating layer coated on surfaces of the magnetic particles. The resin coating layer contains a coating resin having a structural unit represented by Formula (NA).

With the above configuration, the carrier according to the exemplary embodiment prevents a fluctuation in image density which occurs when the environment changes from a high-temperature high-humidity environment (for example, an environment at a temperature of 30° C. and humidity of 88% RH) to a high-temperature low-humidity environment (for example, an environment at a temperature of 30° C. and humidity of 15% RH). The reasons are assumed as follows.

First, when images are continuously printed for a long period of time, a fixing unit may be operated in a state of a high temperature, and a temperature in an image forming apparatus may increase and humidity therein may decrease. For example, in a case where images are continuously printed in the high-temperature high-humidity environment, the temperature in the image forming apparatus may increase and humidity therein may decrease, and the environment therein may become similar to the state of the high-temperature low-humidity environment. That is, the environment in the image forming apparatus may change from the high-temperature high-humidity environment to the high-temperature low-humidity environment.

The environmental change from the high-temperature high-humidity environment to the high-temperature low-humidity environment causes a fluctuation in a charging amount of a developer, and this may cause a difference in image density between images in an initial stage and images in a later stage during the continuous printing of the images. It is considered that this fluctuation in the charging amount of the developer occurs due to a fluctuation in a charging amount of the carrier due to a fluctuation of the amount of adsorption water which is adsorbed by (the coating resin of) the resin coating layer of the carrier. A coating resin having high polarity (that is, a coating resin having a polar group) may be used for obtaining a desired charging amount of the carrier in the high-temperature high-humidity environment, and the fluctuation of the amount of adsorption water of the coating resin of the carrier may be affected by the polarity group included in the coating resin.

Herein, a polar group generally has high affinity with water and has a large amount of adsorption water in high humidity. In addition, the polar group easily has charges and is easily charged, but is hardly charged, when water molecules are present around the polar group. Meanwhile, when a temperature increases, a molecular motion of the polar group becomes remarkable and desorption of the adsorption water from the polar group is promoted. The environmental change from the high-temperature high-humidity environment to the high-temperature low-humidity environment promotes the desorption of the adsorption water from the polar group.

That is, in the high-temperature high-humidity environment, the amount of adsorption water of the coating resin is increased and the charging amount of the carrier is decreased, but when the environmental change from the high-temperature high-humidity environment to the high-temperature low-humidity environment occurs, the amount of adsorption water of the coating resin is decreased and the charging amount of the carrier is increased. Accordingly, the fluctuation in the charging amount of the carrier due to the environmental change is related to the fluctuation in the image density.

With respect to this, when the coating resin including a structural unit represented by Formula (NA) is used as the coating resin of the carrier, the fluctuation in the charging amount of the carrier due to the environmental change is prevented. In a polar group [—$R^3$—$N(R^1)(R^2)$] included in a structural unit represented by Formula (NA), charge density of a lone pair of "N" due to an electron donor of alkyl chains (alkyl chains positioning in $R^1$ to $R^3$) around "N" is suitable and affinity with water is high, and therefore, desorption of adsorption water is prevented. By setting a length of the alkyl chains (alkyl chains positioning in $R^1$ to $R^3$) around "N" suitable in the polar group [—$R^3$—$N(R^1)(R^2)$], an increase in the amount of the adsorption water which is excessive in the high-temperature high-humidity environment is reduced due to the steric hindrance thereof. In addition, a deviation of the polar groups hardly occurs and a local charging variation is prevented, by providing the polar group [—$R^3$—$N(R^1)(R^2)$] in the coating resin which is a polymer.

Accordingly, the fluctuation in the amount of the adsorption water of the coating resin due to the environmental change from the high-temperature high-humidity environment to the high-temperature low-humidity environment is prevented. As a result, the fluctuation in the charging amount of the carrier due to the environmental change is prevented.

As described above, it is assumed that the carrier according to the exemplary embodiment prevents the fluctuation in image density from occurring when the environment changes from the high-temperature high-humidity environment to the high-temperature low-humidity environment.

Hereinafter, each element of the carrier according to the exemplary embodiment will be described in detail.

Magnetic Particles

Examples of magnetic particles include magnetic metal particles (for example, particles of iron, steel, nickel, or cobalt), magnetic oxide particles (for example, particles of ferrite or magnetite), and dispersion-type resin particles obtained by dispersing these particles in a resin. In addition, particles obtained by causing a resin to infiltrate into porous magnetic particles are also used as the magnetic particles.

Among these, the ferrite particles are preferable as the magnetic particles. As the ferrite particles, ferrite particles represented by the following formula may be used, for example.

$$(MO)_x(Fe_2O_3)_y \qquad \text{Formula}$$

In the formula, Y represents a value of 2.1 to 2.4 and X represents a value of 3-Y. M represents a metal element and may contain at least Mn as the metal element.

M contains Mn as a main component, and may use a combination of at least one kind selected from a group consisting of Li, Ca, Sr, Sn, Cu, Zn, Ba, Mg, and Ti (preferably a group consisting of Li, Ca, Sr, Mg, and Ti from the environmental aspect).

The magnetic particles are obtained by magnetic granulating and sintering and the magnetic material may be pulverized as a preprocessing thereof. The pulverization method is not particularly limited and well-known pulverization methods are used, and specifically, a mortar, a ball mill, or a jet mill is used, for example.

Herein, the resins contained in the dispersion-type resin particles as the magnetic particles is not particularly limited and examples thereof include styrene resins, acrylic resins, phenolic resins, melamine resins, epoxy resins, urethane resins, polyester resins, and silicone resins. Other components such as a charge-controlling agent or fluorine-containing particles maybe further contained in the dispersion-type resin particles as the magnetic particles, according to the purpose.

In the magnetic particles, it is preferable that an ruggedness average spacing Sm of the surface satisfies a relationship of 1.0 μm≤Sm≤3.5 μm and an arithmetic surface roughness Ra of the surface satisfies a relationship of 0.2 μm≤Ra≤0.7 μm, from a viewpoint of prevention of the fluctuation in the image density. In the magnetic particles, it is more preferable that the ruggedness average spacing Sm of the surface satisfies a relationship of 2.0 μm≤Sm≤3.0 μm and the arithmetic surface roughness Ra of the surface satisfies a relationship of 0.4 μm≤Ra≤0.5 μm, from a viewpoint of prevention of the fluctuation in the image density.

When the ruggedness average spacing Sm of the surface of the magnetic particles is equal to or greater than 1.0 μm and the arithmetic surface roughness Ra thereof is equal to or greater than 0.2 μm, protrusions (projection portions) of the surface of the magnetic particles have a suitable size, and when the resin coating layer is formed, the exposed portion of the magnetic particles easily has a spotted state, rather than a planar state, and charge leakage hardly occurs. Accordingly, it is easy to prevent the fluctuation in the charging amount of the carrier due to the environmental change. Meanwhile, when the ruggedness average spacing Sm is equal to or smaller than 3.5 μm and the arithmetic surface roughness Ra is equal to or smaller than 0.7 μm, an excessively large size of the protrusions of the surface of the magnetic particles is prevented and it is easy to prevent a decrease in fluidity of the carrier. Therefore, it is easy to prevent a decrease in the charging amount of the developer due to a decrease in stirring properties of the toner and the carrier.

Particularly, when the surface of the magnetic particles is exposed due to occurrence of peeling or scraping of the resin coating layer of the carrier over time, the above-mentioned charge leakage and a decrease in fluidity of the carrier easily occur due to the size of the protrusions of the magnetic particles. However, when the ruggedness average spacing Sm and the arithmetic surface roughness Ra of the surface of the magnetic particles are in the range described above, occurrence of these phenomenon is prevented and it is easy to prevent the fluctuation in the charging amount of the carrier due to the environmental change and a decrease in the charging amount of the developer due to a decrease in stirring properties of the toner and the carrier. As a result, it is easy to prevent the fluctuation in the image density.

A volume average particle diameter of the magnetic particles may be, for example, from 10 μm to 500 μm, and is preferably from 20 μm to 100 μm and more preferably from 25 μm to 60 μm.

The ruggedness average spacing Sm of the surface of the magnetic particles, the arithmetic surface roughness Ra of the surface, and the volume average particle diameter D50v are values measured by a method which will be described later as respective examples.

A method of preparing magnetic particles is not particularly limited and the magnetic particles may be prepared as described below, for example.

The magnetic particles may be, for example, suitably prepared by a combination of the following (A) to (E).

(A) Temporary firing is performed before firing.

(B) Pulverization is further performed and granulation is performed from slurry having an adjusted pulverized particle diameter.

(C) $SiO_2$, $SrCO_3$, or the like is used as a surface conditioner.

(D) Temperature and oxygen concentration at the time of firing are adjusted.

(E) A temperature is applied while allowing magnetic particles obtained by the firing to flow.

After performing the temporary firing before the firing, a pulverized particle diameter is controlled. The granulation is performed to obtain a pulverized material having a desired particle size and a volume average particle diameter is determined. A size of a grain boundary which is a base of the magnetic particles is controlled by the pulverized particle diameter after the temporary firing. In addition, ruggedness of the surface is minutely adjusted and BET specific surface area is obtained using $SiO_2$, $SrCO_3$, or the like as an additive. When $SiO_2$ is added, the area of the grain boundary becomes large and Sm may be adjusted to be large. $SrCO_3$ is operated to increase the Ra.

Then, the firing is performed, the temperature and the oxygen concentration are adjusted, and magnetization is performed to obtain ferrite. The size of the entire grain boundary is adjusted according to the firing temperature and the oxygen concentration. When the firing temperature is high, the Sm increases and when the oxygen concentration is high, the Ra easily increases. In addition, the firing temperature and the oxygen concentration remarkably affect resistance and magnetization. As the temperature increases and the oxygen concentration decreases, a degree of magnetization increases and resistance decreases.

After the firing is finished and ferritisation is performed, a size of inner voids is reduced at a temperature at which a ferritisation reaction does not occur. Accordingly, desired magnetic particles are obtained. When a temperature is applied while allowing the particles to flow, a size of voids between the grain boundaries becomes small, and therefore, it is possible to decrease the BET specific surface area without changing Sm and Ra.

Hereinafter, a specific example of a preparing method of magnetic particles will be described, but there is no limitation to materials or numerical values described below, in the preparing method of the magnetic particles.

First, powder of metal oxides or metal salts which are raw materials is mixed with each other and advance firing is performed at a temperature of 900° C. Specifically, a mixture of powder of $Fe_2O_3$, $MnO_2$, $SrCO_3$, and $Mg(OH)_2$ as raw materials is fired at a temperature of 900° C. using a rotary kiln and the metal oxide is set as the raw material. Next, polyvinyl alcohol, water, a surfactant, and a defoamer are added to the obtained fired material and pulverized by a wet-type ball mill until an average particle diameter becomes 2.0 μm. Then, the pulverized material is set in a droplet state using a spray drier to perform drying. The dried particles are fired again at a temperature of 950° C. using a rotary kiln and the containing organic materials are removed at a high temperature. Then, polyvinyl alcohol, water, a surfactant, and a defoamer are added to the dried particles after removing the containing organic materials, and pulverized by a wet-type ball mill until an average particle diameter becomes 5.6 μm. The pulverized material is set in a droplet state again using a spray drier to perform drying. An average particle diameter of the dried particles at this time is set as 40 μm. The dried particles are fired at a temperature of 1,300° C. using a rotary kiln. Then, a crushing process and a classification process are performed with respect to the fired material and ferrite particles having an average particle diameter of 35 μm are obtained.

Resin Coating Layer

The resin coating layer contains a coating resin (hereinafter, also referred to as a "coating resin (A)") including a structural unit represented by Formula (NA).

Structural Unit Represented by Formula (NA)

(NA)

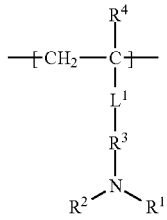

In Formula (NA), $R^1$ and $R^2$ each independently represents a hydrogen atom or an alkyl group having 1 to 4 carbon atoms. Herein, at least one of $R^1$ and $R^2$ represents an alkyl group having 1 to 4 carbon atoms. $R^1$ and $R^2$ do not represent a methyl group or an ethyl group at the same time.

$R^3$ represents an alkylene group having 1 to 3 carbon atoms.

$R^4$ represents a hydrogen atom or a methyl group.

$L^1$ represents —C(═O)—O— or —C(═O)—NH—.

In Formula (NA), an alkyl group represented by $R^1$ and $R^2$ may be linear or branched, and is preferably linear, from a viewpoint of prevention of the fluctuation in the image density. The number of carbon atoms of the alkyl group is from 1 to 4 and preferably from 2 to 4, from a viewpoint of prevention of the fluctuation in the image density.

When at least one of $R^1$ and $R^2$ represents an alkyl group having 2 or more carbon atoms, it is easy to prevent an excessive increase in the amount of the adsorption water of the coating resin in the high-temperature high-humidity environment and it is easy to prevent the charging amount of the carrier due to the environmental change from the high-temperature high-humidity environment to the high-temperature low-humidity environment. When at least one of $R^1$ and $R^2$ represents an alkyl group having 4 or less carbon atoms, an excessive steric hindrance is prevented, and a decrease in frictional charging of the toner and the carrier is prevented. Therefore, it is easy to prevent the fluctuation in the image density.

Particularly, when one of $R^1$ and $R^2$ represents an alkyl group having 1 to 4 carbon atoms (preferably 2 to 4 carbon atoms), a steric hindrance is not excessively strong, and accordingly, a balance between the steric hindrance and the charging density around "N" due to an electron donor of alkyl chains become suitable. Therefore, it is easy to prevent the fluctuation in the image density.

$R^1$ and $R^2$ do not represent a methyl group at the same time and do not represent an ethyl group either at the same time. That is, the structural unit represented by Formula (NA) is a structural unit except a structural unit in which $R^1$ and $R^2$ represent a methyl group and a structural unit in which $R^1$ and $R^2$ represent an ethyl group.

In Formula (NA), an alkylene group represented by $R^3$ may be linear or branched, and is preferably linear, from a viewpoint of prevention of the fluctuation in the image density. The number of carbon atoms of the alkylene group is from 1 to 3 and preferably from 2 to 3, from a viewpoint of prevention of the fluctuation in the image density. When $R^3$ represents an alkylene group having 1 to 3 carbon atoms, a complicated movement (particularly, rotation) of molecules in the high-temperature environment is prevented and frictional charging of the toner and the carrier easily occurs. Therefore, it is easy to prevent the fluctuation in the image density.

The structural unit represented by Formula (NA) may be particularly a structural unit in which $R^1$ and $R^2$ each independently represents a hydrogen atom or an alkyl group having 2 to 4 carbon atoms (herein, at least one of $R^1$ and $R^2$ (preferably, one of $R^1$ and $R^2$) represents an alkyl group having 2 to 4 carbon atoms), $R^3$ represents an alkylene group having 2 to 3 carbon atoms, $R^4$ represents a hydrogen atom or a methyl group (preferably, a methyl group), and $L^1$ represents —C(═O)—O—, in Formula (NA).

Examples of a polymerizable monomer for forming the structural unit represented by Formula (NA) include monoalkyl aminoalkyl (meth)acrylate (monoethyl aminoethyl (meth)acrylate, monopropyl aminoethyl (meth)acrylate, monobutyl aminoethyl (meth)acrylate, monoethyl aminoethyl (meth)acrylate, or monoethylaminopropyl (meth)acrylate), and dialkyl aminoalkyl (meth)acrylate (dipropyl aminoethyl (meth)acrylate or dibutyl aminoethyl (meth) acrylate). These polymerizable monomer may be used alone or in combination of two or more kinds thereof.

The content (polymerization ratio) of the structural unit represented by Formula (NA) is preferably from 0.1% by weight to 30% by weight, more preferably from 0.1% by weight to 10% by weight, even more preferably from 0.5% by weight to 5% by weight, and particularly preferably from 0.5% by weight to 3% by weight with respect to the coating resin (A), from a viewpoint of prevention of the fluctuation in the image density.

Structural Unit Including a Cycloalkyl Group

The coating resin (A) preferably includes the structural unit represented by Formula (NA) and a structural unit including a cycloalkyl group. When the coating resin (A) further includes the structural unit including a cycloalkyl group, it is easy to prevent a change in the charging amount of the carrier due to the environmental change from the high-temperature high-humidity environment to the high-temperature low-humidity environment, due to the steric hindrance of the polar group [—$R^3$—N($R^1$)($R^2$)] and hydrophobic properties of a cycloalkyl group. Therefore, it is easy to prevent the fluctuation in the image density.

Herein, as the cycloalkyl group, a cycloalkyl group having 3 membered-ring to 10 membered-ring is used, for example. The cycloalkyl group is preferably a cycloalkyl group having 3 to 8 membered-ring (3 to 8 carbon atoms) and is more preferably a cycloalkyl group having 5 to 6 membered-ring (5 to 6 carbon atoms) (cyclopentyl or cyclohexyl), from a viewpoint of prevention of the fluctuation in the image density.

Examples of a polymerizable monomer for forming the structural unit including the cycloalkyl group include cycloalkyl (meth)acrylate (cyclopentyl (meth)acrylate, cyclohexyl (meth)acrylate, or cyclooctyl (meth)acrylate). These polymerizable monomers may be used alone or in combination of two or more kinds thereof. Among these, cycloalkyl methacrylate may be particularly used as the polymerizable monomer.

The content (polymerization ratio) of the structural unit including the cycloalkyl group is preferably from 80% by weight to 99.9% by weight, more preferably from 90% by weight to 99.5% by weight, and even more preferably from 95% by weight to 99.5% by weight with respect to the coating resin (A), from a viewpoint of prevention of the fluctuation in the image density.

Other Structural Units

The coating resin (A) may include structural units other than the structural unit represented by Formula (NA) and the structural unit including the cycloalkyl group.

Examples of a polymerizable monomer for forming the other structural units include alkyl (meth)acrylate, alkylamino (meth)acrylate, and the like. These polymerizable monomer may be used alone or in combination of two or more kinds thereof.

Characteristics of Coating Resin (A)

A weight average molecular weight Mw of the coating resin (A) is preferably from 3,000 to 200,000.

The weight average molecular weight Mw of the coating resin (A) is measured by gel permeation chromatography (GPC). The measurement by GPC is performed with tetrahydrofuran (THF) as a solvent, using HLC-8120 GPC and SC-8020 manufactured by Tosoh Corporation and two TSK-GEL SUPER HM-H (manufactured by Tosoh Corporation, 6.0 mm ID×15 cm) as a column. Under the experiment conditions, a sample concentration is set as 0.5% by weight, a flow rate is set as 0.6 ml/min, a sample injection amount is set as 10 μl, and a measurement temperature is set as 40° C., and the experiment is performed using a refractive index (RI) detector (differential refractive index detector). A calibration curve is created from 10 samples of "POLYSTYLENE STANDARD SAMPLE TSK STANDARD" manufactured by Tosoh Corporation: "A-500", "F-1", "F-10", "F-80", "F-380", "A-2500", "F-4", "F-40", "F-128", and "F-700".

Other Characteristics

The resin coating layer may further contain a coating resin (B) including a structural unit including a cycloalkyl group, in combination with the coating resin (A). When the coating resin (B) is used in combination with the coating resin (A), it is easy to prevent a change in the charging amount of the carrier due to the environmental change from the high-temperature high-humidity environment to the high-temperature low-humidity environment, due to the steric hindrance of the polar group [—$R^3$—N($R^1$)($R^2$)] and hydrophobic properties of a cycloalkyl group. Therefore, it is easy to prevent the fluctuation in the image density.

The coating resin (B) may be a resin having only the structural unit including a cycloalkyl group or may be a resin having the structural unit including a cycloalkyl group and another structural unit, and is preferably a resin having the structural unit including a cycloalkyl group and another structural unit.

Examples of a polymerizable monomer for forming the structural unit including a cycloalkyl group and the other structural unit are the same as the examples of the polymerizable monomer described for the coating resin (A).

In the coating resin (B), the content (polymerization ratio) of the structural unit including a cycloalkyl group is preferably from 30% by weight to 100% by weight, more preferably from 50% by weight to 100% by weight, and even more preferably from 70% by weight to 100% by weight with respect to the coating resin (A), from a viewpoint of prevention of the fluctuation in the image density.

A weight average molecular weight Mw of the coating resin (B) is preferably from 3,000 to 200,000.

The weight average molecular weight Mw of the coating resin (B) is measured by the same method used in the measurement of the weight average molecular weight of the coating resin (A).

Content of Coating Resin

In a case of using the coating resin (A) alone and a case of using the coating resin (A) and the coating resin (B) in combination, it is preferable to set the content of each coating resin, so that the content of the structural unit represented by Formula (NA) is in a range of 0.1% by weight to 30% by weight (preferably, 0.1% by weight to 10% by weight and more preferably, 0.1% by weight to 5.0% by weight) with respect to the entirety of resin components.

Characteristics of Coating Resin Layer

The coating resin layer may contain other additives such as a conductive material, for example.

Examples of conductive particles include metal oxides such as carbon black, various metal powder, titanium oxide, tin oxide, magnetite, and ferrite. These may be used alone or in combination of two or more kinds thereof. Among these, carbon black particles are preferable, from the viewpoints of production stability, cost, and conductivity. The kind of the carbon black is not particularly limited and carbon black having an DBP oil adsorption amount of 50 ml/100 g to 250 ml/100 g is preferable from a viewpoint of excellent production stability.

A coating method using a coating layer forming solution in which a coating resin, and if necessary, various additives are dissolved in an appropriate solvent is used to coat the surface of the magnetic particles with the coating resin layer. The solvent is not particularly limited and may be selected in consideration of the coating resin to be used, coating suitability, and the like.

Specific examples of the resin coating method include a dipping method of dipping magnetic particles in a coating layer forming solution, a spraying method of spraying a coating layer forming solution to surfaces of cores, a fluid bed method of spraying a coating layer forming solution in a state in which magnetic particles are allowed to float by flowing air, and a kneader-coater method in which magnetic particles of a carrier and a coating layer forming solution are mixed with each other in a kneader-coater and the solvent is removed.

Herein, a coating amount of the coating resin layer may be, for example, equal to or greater than 0.5% by weight (preferably, from 0.7% by weight to 6% by weight and more preferably, from 1.0% by weight to 5.0% by weight) with respect to the magnetic particles of the resin coating layer.

When the coating amount of the coating resin layer is equal to or smaller than 6% by weight with respect to the magnetic particles, the surface shape of the carrier is maintained as the surface shape (ruggedness average spacing Sm of the surface and arithmetic surface roughness Ra of the surface) of the magnetic particles.

Herein, the coating amount is determined as follows.

In a case of a solvent-soluble coating resin, the weighed carrier is dissolved in a soluble solvent (for example, toluene), magnetic particles are maintained in magnet, and a solution obtained by the coating resin is washed. This operation is repeated several times so that magnetic particles from which the coating resin is extracted remain. The magnetic particles are dried, a weight thereof is measured, and a difference is divided by the carrier amount, to calculate the coating amount.

Specifically, 20.0 g of the carrier is measured and put in a beaker, 100 g of toluene is added thereto and stirred using stirring blades for 10 minutes. Toluene is allowed to flow while not allowing cores (magnetic particles) by attaching the magnet to the bottom of the beaker. This operation is repeated four times, and the beaker after the washing is dried. The amount of the dried magnetic particles is measured and the coating amount is calculated by an expression of [(carrier amount−amount of washed magnetic particles)/carrier amount].

Meanwhile, in a case of a solvent-insoluble coating resin, the heating is performed in a range of room temperature (25° C.) to 1,000° C. under the nitrogen atmosphere and the coating amount is calculated from a decrease in the weight thereof, using THERMO PLUS EVOII differential thermogravimetric analyzer TG 8120 manufactured by Rigaku Corporation.

Electrostatic Charge Image Developer

The electrostatic charge image developer according to the exemplary embodiment (hereinafter, also referred to as a "developer") includes an electrostatic charge image developing toner (hereinafter, also referred to as a "toner") and the electrostatic charge image developing carrier according to the exemplary embodiment.

The toner includes toner particles. The toner may include external additives, if necessary.

Toner Particles

The toner particles contain a binder resin, for example. The toner particles may contain a colorant, a release agent, and other additives, if necessary.

Binder Resin

Examples of the binder resins include a homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used alone or in combination with two or more kinds thereof.

The content of the binder resin is, for example, preferably from 40% by weight to 95% by weight, more preferably from 50% by weight to 90% by weight, and even more preferably from 60% by weight to 85% by weight with respect to the entire toner particle.

Colorant

Examples of a colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The other colorants may be used alone or in combination of two or more kinds thereof.

As the colorant, a surface-treated colorant may be used if necessary, and a dispersing agent may be used in combination. In addition, plural kinds may be used in combination as other colorants.

The content of the colorant is, for example, preferably from 1% by weight to 30% by weight and more preferably from 3% by weight to 15% by weight with respect to the entire toner particle.

Release Agent

Examples of the release agent include, hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

Further, the melting temperature is determined from a DSC curve obtained by differential scanning calorimetry (DSC), using the "melting peak temperature" described in the method of determining a melting temperature in the "Testing Methods for Transition Temperatures of Plastics" in JIS K-7121-1987.

The content of the release agent is, for example, preferably from 1% by weight to 20% by weight and more preferably from 5% by weight to 15% by weight with respect to the entire toner particle.

Other Additives

Examples of other additives include known additives such as a magnetic material, a charge-controlling agent, and an inorganic powder. These additives are included as internal additives in the toner particles.

Characteristics of Toner Particles

The toner particles may be toner particles having a single-layer structure, or toner particles having a so-called core/shell structure composed of a core (core particle) and a coating layer (shell layer) coated on the core.

Herein, toner particles having a core/shell structure is preferably composed of, for example, a core containing a binder resin, if necessary, other additives such as a colorant and a release agent, and a coating layer containing a binder resin.

The volume average particle diameter (D50v) of the toner particles is preferably from 2 μm to 10 μm, and more preferably from 4 μm to 8 μm.

Various average particle sizes and various particle size distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle size of 2 μm to 60 μm is measured by a COULTER MULTISIZER II using an aperture having an aperture size of 100 μm. 50,000 particles are sampled.

Cumulative distributions by volume and by number are drawn from the side of the smallest size with respect to particle size ranges (channels) separated based on the measured particle size distribution. The particle size when the cumulative percentage becomes 16% is defined as that corresponding to a volume average particle diameter D16v and a number average particle diameter D16p, while the particle size when the cumulative percentage becomes 50% is defined as that corresponding to a volume average particle diameter D50v and a number average particle diameter D50p. Furthermore, the particle size when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably treated with a hydrophobizing agent. The treatment with a hydrophobizing agent is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin particles) and a cleaning aid (e.g., metal salt of higher fatty acid represented by zinc stearate, and fluorine polymer particles).

The amount of the external additive externally added is, for example, preferably from 0.01% by weight to 5% by weight, and more preferably from 0.01% by weight to 2.0% by weight with respect to the toner particles.

Toner Preparing Method

Next, a method of preparing a toner will be described.

The toner is obtained by externally adding an external additive to toner particles after preparing of the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles are preferably obtained by an aggregation and coalescence method.

The toner according to the exemplary embodiment is prepared, for example, by adding an external additive to the obtained toner particles in a dried state, and performing mixing. The mixing may be performed, for example, by using a V blender, a HENSCHEL MIXER, a LODIGE MIXER, or the like. Furthermore, if necessary, coarse toner particles may be removed using a vibration sieving machine, a wind classifier, or the like.

The mixing ratio (weight ratio) between the toner and the carrier in the developer according to the exemplary embodiment is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative electrostatic charge image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the electrostatic charge image is developed with the yellow toner. Next, the photoreceptor 1Y having the yellow toner image formed thereon continuously travels at a predetermined rate and the toner image developed on the photoreceptor 1Y is transported to a predetermined primary transfer position.

Herein, the developing device 4Y may be a trickle development type developing device which performs developing while replacing (discharge and supply) some carrier in the accommodated developer. In a case where the developing device 4Y is a trickle development type developing device, the developing device may be connected to a developer cartridge accommodating a developer containing a yellow toner and a carrier, instead of the toner cartridge 8Y, via developer supply tubes (not shown) to supply a developer for replenishment to the developer device.

The carrier to be discharged contains a carrier deteriorated due to being stirred in the developing device 4Y.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge/Developer Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
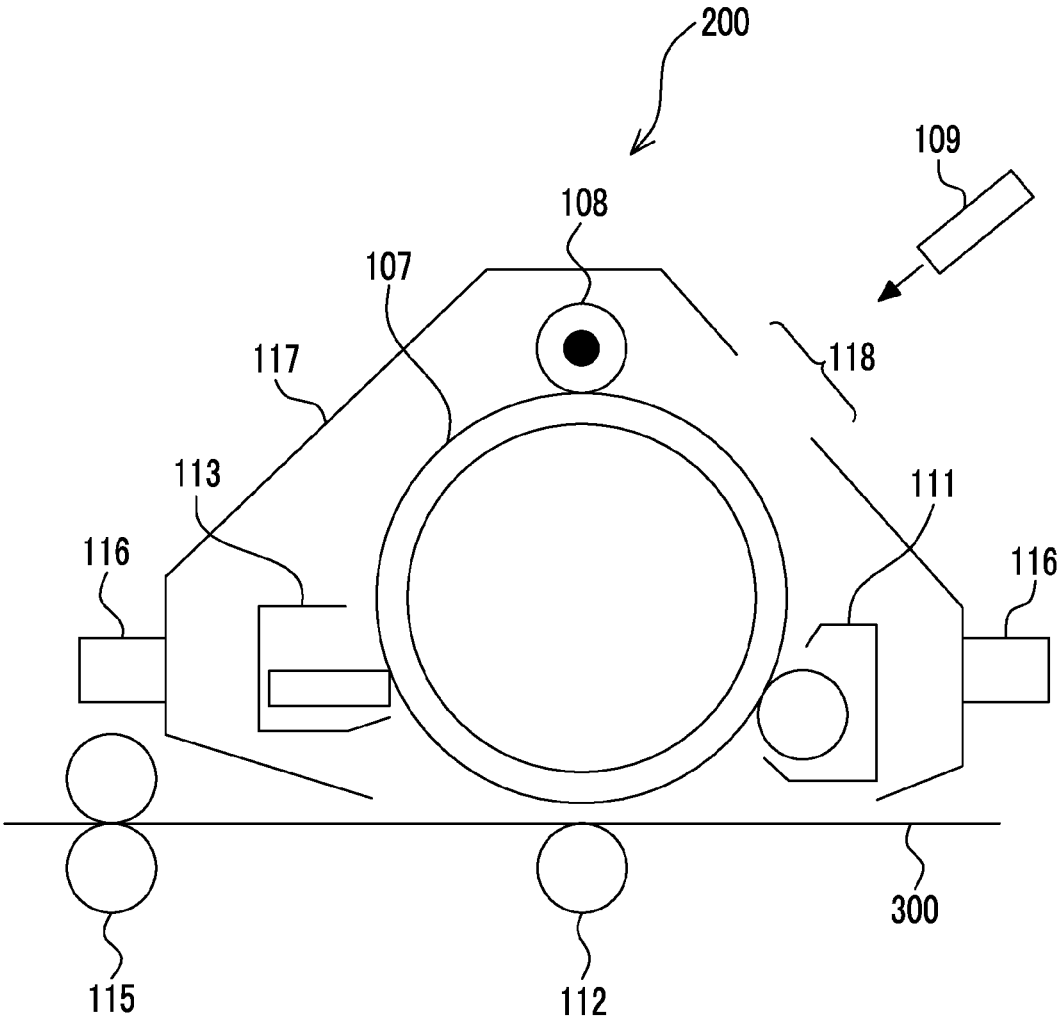
FIG. 2 is a schematic configuration diagram showing an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), and a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a developer cartridge according to this exemplary embodiment will be described.

The developer cartridge according to this exemplary embodiment accommodates the developer according to this exemplary embodiment and is detachable from an image forming apparatus. The developer cartridge accommodates a developer for replenishment for being supplied to the developing unit provided in the image forming apparatus. The developer cartridge according to this exemplary embodiment may include a container that contains the developer.

The developer cartridge according to the exemplary embodiment is suitably applied to an image forming apparatus including a trickle type developing device.

For example, the image forming apparatus shown in FIG. 1 may be an image forming apparatus in which the toner cartridges 8Y, 8M, 8C, and 8K are replaced as the developer cartridges according to the exemplary embodiment, the developers are supplied to the developing devices 4Y, 4M, 4C, and 4K from the developer cartridges, and developing is performed while replacing the carrier accommodated in the developing devices 4Y, 4M, 4C, and 4K.

In addition, in a case where the developer accommodated in the developer cartridge runs low, the developer cartridge is replaced.

EXAMPLES

Hereinafter, the invention will be described in detail based on examples and comparative examples, but is not limited to these examples. Unless specifically noted, "%" means "% by weight" and "parts" means "parts by weight".

Preparation of Magnetic Particles

Magnetic Particles 1

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water are added to the mixture, and 6.6 parts by weight of polyvinyl alcohol is further added thereto, and the resultant is pulverized and mixed by a wet type ball mill for 5 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 1% at 1,100° C. for 5 hours. The obtained particles are subjected to a cracking process and a classification process, heated by a rotary kiln under the conditions of 15 rpm and 900° C. for 2 hours, subjected to the classification process in the same manner, and magnetic particles 1 are obtained. A volume average particle diameter D50v (hereinafter, also referred to as "D50v") of the magnetic particles 1 is 35 μm, a ruggedness average spacing Sm of the surface (hereinafter, also referred to as "Sm") is 2.5, and arithmetic surface roughness Ra of the surface (hereinafter, also referred to as "Ra") is 0.4.

Magnetic Particles 2

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water are added to the mixture, and 6.6 parts by weight of polyvinyl alcohol is further added thereto, and the resultant is pulverized and mixed by a wet type ball mill for 6 hours. A volume average particle diameter of the obtained pulverized product is 1.2 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.2% at 1170° C. for 5 hours. The obtained particles are subjected to a cracking process and a classification process, heated by a rotary kiln under the conditions of 15 rpm and 900° C. for 2 hours, subjected to the classification process in the same manner, and thus, magnetic particles 2 are obtained. The D50v of the magnetic particles 2 is 35 μm, the Sm is 1.0, and the Ra is 0.5.

Magnetic Particles 3

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water are added to the mixture, and 6.6 parts by weight of polyvinyl alcohol is further added thereto, and the resultant is pulverized and mixed by a wet type ball mill for 3 hours. A volume average particle diameter of the obtained pulverized product is 2.2 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1120° C. for 5 hours. The obtained particles are subjected to a cracking process and a classification process, heated by a rotary kiln under the conditions of 15 rpm and 920° C. for 2 hours, subjected to the classification process in the same manner, and thus, magnetic particles 3 are obtained. The D50v of the magnetic particles 3 is 35 μm, the Sm is 3.5, and the Ra is 0.6.

Magnetic Particles 4

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water are added to the mixture, and 7 parts by weight of polyvinyl alcohol is further added thereto, and the resultant is pulverized and mixed by a wet type ball mill for 5 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 0.8% at 1,100° C. for 5 hours. The obtained particles are subjected to a cracking process and a classification process, heated by a rotary kiln under the conditions of 15 rpm and 890° C. for 2 hours, subjected to the classification process in the same manner, and thus, magnetic particles 4 are obtained. The D50v of the magnetic particles 4 is 35 μm, the Sm is 2.5, and the Ra is 0.2.

Magnetic Particles 5

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water are added to the mixture, and 6 parts by weight of polyvinyl alcohol is further added thereto, and the resultant is pulverized and mixed by a wet type ball mill for 3.5 hours. A volume average particle diameter of the obtained pulverized product is 1.8 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1170° C. for 5 hours. The obtained particles are subjected to a cracking process and a classification process, heated by a rotary kiln under the conditions of 15 rpm and 900° C. for 2 hours, subjected to the classification process in the same manner, and thus, magnetic particles 5 are obtained. The D50v of the magnetic particles 5 is 35 μm, the Sm is 2.5, and the Ra is 0.7.

Magnetic Particles 6

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water is added to the mixture, and 7.6 parts by weight of polyvinyl alcohol is further added thereto, and the resultant is pulverized and mixed by a wet type ball mill for 7 hours. A volume average particle diameter of the obtained pulverized product is 1.0 μm. Then, granulating and drying are performed so that a diameter of the particles dried by a spray drier becomes 40 μm. In addition, firing is performed in an electric furnace in an oxygen nitrogen mixed atmosphere having oxygen concentration of 0.8% at 1,050° C. for 5 hours. The obtained particles are subjected to a cracking process and a classification process, heated by a rotary kiln under the conditions of 15 rpm and 920° C. for 2 hours, subjected to the classification process in the same manner, and thus, magnetic particles 6 are obtained. The D50v of the magnetic particles 6 is 35 μm, the Sm is 0.8, and the Ra is 0.4.

Magnetic Particles 7

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. Then, a dispersing agent and water is added to the mixture, and 5.4 parts by weight of polyvinyl alcohol is further added thereto, and the resultant is pulverized and mixed by a wet type ball mill for 3 hours. A volume average particle diameter of the obtained pulverized product is 2.3 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1,120° C. for 5 hours. The obtained particles are subjected to a cracking process and a classification process, heated by a rotary kiln under the conditions of 15 rpm and 900° C. for 2 hours, subjected to the classification process in the same manner, and thus, magnetic particles 7 are obtained. The D50v of the magnetic particles 7 is 35 μm, the Sm is 3.8, and the Ra is 0.6.

Magnetic Particles 8

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water is added to the mixture, and 6.9 parts by weight of polyvinyl alcohol is further added thereto, and the resultant is pulverized and mixed by a wet type ball mill for 5 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 0.7% at 1160° C. for 5 hours. The obtained particles are subjected to a cracking process and a classification process, heated by a rotary kiln under the conditions of 15 rpm and 920° C. for 2 hours, subjected to the classification process in the same manner, and thus, magnetic particles 8 are obtained. The D50v of the magnetic particles 8 is 35 μm, the Sm is 2.3, and the Ra is 0.1.

Magnetic Particles 9

1,318 parts by weight of $Fe_2O_3$, 586 parts by weight of $Mn(OH)_2$, and 96 parts by weight of $Mg(OH)_2$ are mixed with each other, a dispersing agent, water, and zirconia beads having a median diameter of 1 mm are added thereto, and the mixture is cracked and mixed with each other by a sand mill. The zirconia beads are filtered, dried, and the resultant is processed by a rotary kiln under the conditions of 20 rpm and 900° C. to obtain a mixed oxide. Then, a dispersing agent and water is added to the mixture, and 6 parts by weight of polyvinyl alcohol is further added thereto, and the resultant is pulverized and mixed by a wet type ball mill for 5.2 hours. A volume average particle diameter of the obtained pulverized product is 1.4 μm. Then, granulating and drying are performed so that a diameter of the particles dried by a spray drier becomes 40 μm. In addition, firing is performed in an electric furnace in an oxygen nitrogen mixed atmosphere having oxygen concentration of 1.5% at 1,150° C. for 5 hours. The obtained particles are subjected to a cracking process and a classification process, heated by a rotary kiln under the conditions of 15 rpm and 890° C. for 2 hours, subjected to the classification process in the same manner, and thus, magnetic particles 9 are obtained. The D50v of the magnetic particles 9 is 35 μm, the Sm is 2.7, and the Ra is 0.8.

Preparation of Coating Solution

Coating Solution A1

| | |
|---|---|
| A cyclohexyl methacrylate-monoethyl aminoethyl methacrylate copolymer (weight ratio of 95:5/weight average molecular weight Mw (hereinafter, also referred to as "Mw") of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution A1 having solid content of 11%.

Coating Solution A2

| | |
|---|---|
| A cyclohexyl methacrylate-monopropyl aminoethyl methacrylate copolymer (weight ratio of 95:5/Mw of 100,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution A2 having solid content of 11%.

Coating Solution A3

| | |
|---|---|
| A cyclohexyl methacrylate-monobutyl aminoethyl methacrylate copolymer (weight ratio of 95:5/Mw of 100,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution A3 having solid content of 11%.

Coating Solution A4

| | |
|---|---|
| A cyclohexyl methacrylate-monoethyl aminopropyl methacrylate copolymer (weight ratio of 95:5/Mw of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution A4 having solid content of 11%.

Coating Solution A5

| | |
|---|---|
| A methyl methacrylate-monoethyl aminoethyl methacrylate copolymer (weight ratio of 95:5/Mw of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution A5 having solid content of 11%.

Comparative Coating Solution A6

| | |
|---|---|
| A cyclohexyl methacrylate-monopentyl aminoethyl methacrylate copolymer (weight ratio of 95:5/Mw of 80,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution A6 having solid content of 11%.

Coating Solution A7

| | |
|---|---|
| A methyl methacrylate-cyclohexyl methacrylate copolymer (weight ratio of 95:5/Mw of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution A7 having solid content of 11%.

Comparative Coating Solution A8

| | |
|---|---|
| A cyclohexyl methacrylate copolymer (Mw: 60,000): | 35 parts by weight |
| A monoaminoethyl methacrylate oligomer (Mw: 5,000): | 1 part by weight |
| Carbon black VXC 72 (manufactured by Cabot Corporation): | 4 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution A8 having solid content of 11%.

Coating Solution A9

| | |
|---|---|
| A cyclohexyl methacrylate-monoethyl aminoethyl acrylamide copolymer (weight ratio of 95:5/Mw of 100,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution A9 having solid content of 11%.

Comparative Coating Solution B1

| | |
|---|---|
| A cyclohexyl methacrylate-diethyl aminoethyl methacrylate copolymer (weight ratio of 95:5/Mw of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution B1 having solid content of 11%.

Coating Solution B2

| | |
|---|---|
| A cyclohexyl methacrylate-dipropyl aminoethyl methacrylate copolymer (weight ratio of 95:5/Mw of 100,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution B2 having solid content of 11%.

Coating Solution B3

| | |
|---|---|
| A cyclohexyl methacrylate-dibutyl aminoethyl methacrylate copolymer (weight ratio of 95:5/Mw of 100,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a coating solution B3 having solid content of 11%.

Comparative Coating Solution B4

| | |
|---|---|
| A cyclohexyl methacrylate-diethyl aminopropyl methacrylate copolymer (weight ratio of 95:5/Mw of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution B4 having solid content of 11%.

Comparative Coating Solution B5

| | |
|---|---|
| A methyl methacrylate-diethyl aminoethyl methacrylate copolymer (weight ratio of 95:5/Mw of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution B5 having solid content of 11%.

Comparative Coating Solution B6

| | |
|---|---|
| A cyclohexyl methacrylate-diethyl aminopropyl methacrylate copolymer (weight ratio of 95:5/Mw of 80,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution B6 having solid content of 11%.

Comparative Coating Solution B7

| | |
|---|---|
| A methyl methacrylate-cyclohexyl methacrylate copolymer (weight ratio of 95:5/Mw of 60,000): | 36 parts by weight |
| Carbon black VXC 72 (manufactured by Cabot Corporation): | 4 parts by weight |
| Toluene (manufactured by Wako Pure Chemical Industries, Ltd.): | 500 parts by weight |

-continued

| | |
|---|---|
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution B7 having solid content of 11%.

Comparative Coating Solution B8

| | |
|---|---|
| A cyclohexyl methacrylate copolymer (Mw of 60,000): | 36 parts by weight |
| Amino-modified silicone oil KF-8008 (Shin-Etsu Chemical Co., Ltd.): | 1 part by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution B8 having solid content of 11%.

Comparative Coating Solution B9

| | |
|---|---|
| A cyclohexyl methacrylate copolymer (Mw: 60,000): | 35 parts by weight |
| A dipropyl aminoethyl methacrylate oligomer (MW: 5,000): | 1 part by weight |
| Carbon black VXC 72 (manufactured by Cabot Corporation): | 4 parts by weight |
| Toluene (manufactured by Wako Pure Chemical Industries, Ltd.): | 500 parts by weight |
| Isopropyl alcohol (manufactured by Wako Pure Chemical Industries, Ltd.): | 50 parts by weight |

The above components and glass beads (particle diameter: 1 mm, same weight as that of toluene) are put in a sand mill manufactured by Kansai Paint Co., Ltd. and stirred at a rotation rate of 1,200 rpm for 30 minutes, to prepare a comparative coating solution B9 having solid content of 11%.

Example A1

2.0 kg of the magnetic particles 1 are put in a 5 L-sized vacuum degassing type kneader, 340 g of the coating solution A1 is then put therein, the mixture is mixed for 20 minutes while being stirred under the reduced pressure of −200 mmHg at 60° C., and then stirred and dried for 30 minutes at 90° C. and −720 mHg by increasing the temperature and reducing the pressure, and a carrier A1 is obtained.

Examples A2 to A14, Comparative Examples A1 to A3, Examples B1 to B10, and Comparative Examples B1 to B7

Carriers A2 to A17 and carriers B1 to B7 are obtained in the same manner as in Example A1 (carrier A1), except for changing the kinds of the magnetic particles and the coating solution according to Table 1 and Table 2.

Measurement of Properties of Magnetic Particles

Regarding carries obtained in the respective examples, after removing the resin coating layer (coating resin) as described below, the ruggedness average spacing Sm of the surface of the magnetic particles, the arithmetic surface roughness Ra of the surface, and the volume average particle diameter D50v are respectively measured by the following methods.

Removal of Coating Resin 20 g of a carrier is put in 100 ml of toluene. Ultrasonic waves are emitted thereto for 3 minutes under the condition of 40 kHz. The magnetic particles and the resin solution are separated using a filtrate selected according to the particle diameter. 20 ml of toluene is allowed to flow to the magnetic particles remaining in the filtrate from the top and washed. Then, the magnetic particles remaining in the filtrate are collected. The collected magnetic particles are put in 100 ml of toluene in the same manner and ultrasonic waves are emitted thereto for 3 minutes under the condition of 40 kHz. The magnetic particles are filtered, washed by 20 ml of toluene, and collected, in the same manner as described above. This operation is performed total 10 times. The magnetic particles finally collected are dried.

Ruggedness Average Spacing Sm and Arithmetic Surface Roughness Ra of Surface

In the measurement of the ruggedness average spacing Sm and the arithmetic surface roughness Ra of the surface of the magnetic particles, a method of determining the values by performing the conversion of the surface with a magnification of 3,000 using a super-depth color 3D shape measurement microscope (VK-9500 manufactured by Keyence Corporation) regarding 50 magnetic particles, is used.

For the ruggedness average spacing Sm, a roughness curve is determined from a three-dimensional shape of the observed surface of the magnetic particles and an average value of intervals of one cycle of a protrusion and a recess determined from an intersection of the roughness curve intersecting with an average line. A reference length when determining the Sm value is 10 μm and a cut-off value is 0.08 mm.

The arithmetic average roughness Ra is determined by determining a roughness curve, adding up absolute values of a deviation between the measurement value and the average value of the roughness curve. A reference length when determining the Ra value is 10 μm and a cut-off value is 0.08 mm.

The measurement of the Sm value and the Ra value are performed based on JIS B0601 (1994).

Volume Average Particle Diameter D50v

The volume average particle diameter of the magnetic particles is measured using a laser diffraction-type particle size distribution measuring device "LA-700 (manufactured by Horiba, Ltd.)".

A particle diameter of the pulverized particles or the like during preparing the magnetic particles is also measured in the same manner as described above.

Evaluation

The carriers obtained in the respective examples are evaluated as follows. The results are shown in Table 1 and Table 2.

Preparation of Toner

Colorant Dispersion 1

| | |
|---|---|
| Cyan pigment: copper phthalocyanine B15:3 (manufactured by Dainichiseika Color & Chemicals Mfg. Co., Ltd.): | 50 parts by weight |
| Anionic surfactant: NEOGEN SC manufactured by DKS Co., Ltd.): | 5 part by weight |
| Ion exchange water: | 200 parts by weight |

The above materials are mixed with each other and dispersed using ULTRA TURRAX manufactured by IKA Works, Inc. for 5 minutes and then using an ultrasonic bath for 10 minutes, and a colorant dispersion 1 having solid content of 21% by weight is obtained. When the volume average particle diameter is measured by a particle size measuring device LA-700 manufactured by Horiba, Ltd., the volume average particle diameter is 160 nm.

Release Agent Dispersion 1

| | |
|---|---|
| Paraffin Wax: HNP-9 (manufactured by Nippon Seiro Co., Ltd.): | 19 parts by weight |
| Anionic surfactant: NEOGEN SC (manufactured by DES Co., Ltd.): | 1 part by weight |
| Ion exchange water: | 80 parts by weight |

The above materials are mixed with each other in a heat-resistant vessel, heated to 90° C., and stirred for 30 minutes. Then, the molten liquid is circulated to a GOULIN HOMOGENIZER from the bottom of the vessel, a circulation operation equivalent to 3 passes under the pressure conditions of 5 MPa, the pressure is increased to 35 MPa, and the circulation operation equivalent to 3 passes is further performed. The emulsified solution obtained as described above is cooled until the temperature becomes 40° C. or lower in the heat-resistant vessel, and a release agent dispersion 1 is obtained. When the volume average particle diameter is measured by a particle size measuring device LA-700 manufactured by Horiba, Ltd., the volume average particle diameter is 240 nm.

Resin Particle Dispersion 1

Oil Phase

| | |
|---|---|
| Styrene (manufactured by Wako Pure Chemical Industries, Ltd.): | 30 parts by weight |
| n-butyl acrylate (manufactured by Wako Pure Chemical Industries, Ltd.): | 10 parts by weight |
| β-carboxyethyl acrylate (manufactured by Solvay Nicca, Ltd.): | 1.3 parts by weight |
| Dodecanethiol (manufactured by Wako Pure Chemical Industries, Ltd.): | 0.4 parts by weight |

Water Phase 1

| | |
|---|---|
| Ion exchange water: | 17 parts by weight |
| Anionic surfactant (DOWFAX manufactured by The Dow Chemical Company): | 0.4 parts by weight |

Water Phase 2

| | |
|---|---|
| Ion exchange water: | 40 parts by weight |
| Anionic surfactant (DOWFAX manufactured by The Dow Chemical Company): | 0.05 parts by weight |
| Ammonium peroxodisulfate (manufactured by Wako Pure Chemical Industries, Ltd.): | 0.4 parts by weight |

The oil phase components and components of water phase 1 are put in a flask and stirred and mixed with each other to obtain a monomer emulsion dispersion. The components of water phase 2 are put in a reaction vessel, the atmosphere in the vessel is sufficiently substituted with nitrogen and heated until the atmosphere in a reaction system becomes 75° C. in an oil bath while stirring. The monomer emulsion dispersion is slowly added dropwise in the reaction vessel for 3 hours and emulsified polymerization is performed. After completing the dropwise addition, the polymerization is further continued at 75° C. and the polymerization is completed after 3 hours.

Regarding the obtained resin particles, when the volume average particle diameter D50v of the resin particles is measured by laser diffraction-type particle size distribution measuring device LA-700 (manufactured by Horiba, Ltd.), the volume average particle diameter D50v is 250 nm. When a glass transition temperature of the resin is measured using a differential scanning calorimeter (DSC-50 manufactured by Shimadzu Corporation) at a rate of temperature rise of 10° C./min, and the glass transition temperature is 53° C. When the number average molecular weight (polystyrene conversion) is measured using a molecular weight measuring device (HLC-8020 manufactured by Tosoh Corporation) and using THF as a solvent, the number average molecular weight is 13,000. Accordingly, a resin particle dispersion 1 having the volume average particle diameter 250 nm, the solid content of 42% by weight, the glass transition temperature of 52° C., and the number average molecular weight Mn 13,000 is obtained.

Preparation of Toner

| | |
|---|---|
| Resin particle dispersion 1: | 150 parts by weight |
| Colorant particle dispersion 1: | 30 parts by weight |
| Release agent dispersion 1: | 40 parts by weight |
| Polyaluminum chloride: | 0.4 parts by weight |

After sufficiently mixing and dispersing the above components in a stainless steel flask using ULTRA TURRAX manufactured by IKA Works, Inc, the mixture is heated to 48° C. while stirring the mixture in the flask in an oil bath for heating. After maintaining a temperature at 48° C. for 80 minutes, 70 parts by weight of the resin particle dispersion 1 described above is slowly added thereto.

Then, after adjusting the pH in the system to 6.0 using a sodium hydroxide solution having concentration of 0.5 mol/L, the stainless steel flask is sealed, a seal of a stirring shaft is magnetically sealed, and the temperature is increased to 97° C. while continuing stirring and maintained for 3 hours. After the reaction ends, the mixture is cooled at a rate of temperature decrease of 1° C./min, filtered, and sufficiently washed with ion exchange water, and a solid-liquid separation is performed by Nutsche-type suction filtration. In addition, the solid content is dispersed again using 3 L of ion exchange water at 40° C., stirred and washed at 300 rpm for 15 minutes. This washing operation is further repeated five times. When the pH of the filtrate is 6.54 and electrical conductivity is 6.5 μS/cm, the solid-liquid separation is performed by Nutsche-type suction filtration using No. 5A filter paper. Next, vacuum drying is continued for 12 hours and toner particles are obtained.

When the volume average particle diameter D50v of the toner particles is measured with a COULTER COUNTER, the volume average particle diameter D50v is 6.2 μm and the volume average particle size distribution index GSDv is 1.20. When the shape thereof is observed using LUZEX IMAGE ANALYZER manufactured by LUZEX, the shape factor SF1 of the particles is 135 and a potato shape is observed.

The glass transition temperature of the toner particles is 52° C.

In addition, silica ($SiO_2$) particles having a primary particle average particle diameter of 40 nm and subjected to surface treatment with hydrophobizing agent using hexamethyldisilazane (hereinafter, may be abbreviated as "HMDS"), and metatitanic acid compound particles having a primary particle average particle diameter of 20 nm which is a reaction product of metatitanic acid and isobutyl trimethoxy silane are added to the toner particles so that a coverage with respect to the toner particles becomes 40%, and mixed with each other by HENSCHEL MIXER, and a toner is prepared.

Experimental Evaluation 1

The following experimental evaluation 1 is performed with respect to the carriers A1 to A17 obtained in the respective examples.

A developer obtained by mixing the carrier and the toner to have a weight ratio of 100:6 is loaded in a developing device in a position of a cyan color, in "remodeled DCC 400 (device which is remodeled so as to perform print with only a developing device in a position of a cyan color)" manufactured by Fuji Xerox Co., Ltd. This remodeled DCC 400 is kept in the environment of a temperature of 30° C. and humidity of 88% RH for 12 hours. After keeping, a cyan solid patch image having a size of 10 cm×10 cm (hereinafter, "(C1) image") is printed on one A4-sized sheet. Then, the remodeled DCC 400 is kept in the environment of a temperature of 30° C. and humidity of 15% RH for 12 hours. After keeping, a cyan solid patch image having a size of 10 cm×10 cm (hereinafter, "(C2) image") is printed on one A4-sized sheet.

Next, cyan half-tone images having a size of 15 cm×20 cm and image density of 30% are printed on 1,000 A4-sized sheets under the condition of a temperature of 23° C. and humidity of 50% RH. Then, the remodeled DCC 400 is kept in the environment of a temperature of 30° C. and humidity of 88% RH for 12 hours. After keeping, a cyan solid patch image having a size of 10 cm×10 cm (hereinafter, "(C3) image") is printed on one A4-sized sheet. Then, the remodeled DCC 400 is kept in the environment of a temperature of 30° C. and humidity of 15% RH for 12 hours. After keeping, a cyan solid patch image having a size of 10 cm×10 cm (hereinafter, "(C4) image") is printed on one A4-sized sheet.

A color difference (ΔE) between the C1 image and the C2 image and a color difference (ΔE) between the C3 image and the C4 image are measured. The color difference (ΔE) is measured using a reflection densitometer X-RITE 939 (manufactured by X-Rite, Inc.)

The color difference (ΔE) is square root value of the sum of squares of a distance difference of L*a*b* space in the CIE 1976 (L*a*b*) color system. The CIE 1976 (L*a*b*) color system is a color space regulated by International Commission on Illumination (CIE) in 1976 and based on "JIS Z 8729" based on the Japanese Industrial Standards.

Experimental Evaluation 2

The following experimental evaluation 2 is performed with respect to the carriers B1 to B17 obtained in the respective examples.

A developer obtained by mixing the carrier and the toner to have a weight ratio of 100:6 is loaded in a developing device in a position of a cyan color, in "remodeled DCC 400 (device which is remodeled so as to perform print with only a developing device in a position of a cyan color)" manufactured by Fuji Xerox Co., Ltd. This remodeled DCC 400 is kept in the environment of a temperature of 30° C. and humidity of 88% RH for 12 hours. After keeping, a cyan solid patch image having a size of 10 cm×10 cm (hereinafter, "(C5) image") is printed on one A4-sized sheet. Then, the remodeled DCC 400 is kept in the environment of a temperature of 30° C. and humidity of 15% RH for 12 hours.

After keeping, a cyan solid patch image having a size of 10 cm×10 cm (hereinafter, "(C6) image") is printed on 1,000 A4-sized sheets.

A color difference (ΔE) between the C5 image and the C6 image (C6 image printed on 1,000-th sheet) is measured, in the same manner as in the experimental evaluation 1.

TABLE 1

| | | Magnetic particles | | | | | Experimental evaluation 1 | |
|---|---|---|---|---|---|---|---|---|
| | Carrier Type | Type | D50v (μm) | Sm | Ra | Coating solution Type | Color difference (ΔE) between C1 image and C2 image | Color difference (ΔE) between C3 image and C4 image |
| Ex. 1 | Carrier A1 | Magnetic particles 1 | 35 | 2.5 | 0.4 | Coating solution A1 | 0.5 | 0.6 |
| Ex. 2 | Carrier A2 | Magnetic particles 1 | 35 | 2.5 | 0.4 | Coating solution A2 | 0.6 | 0.6 |
| Ex. 3 | Carrier A3 | Magnetic particles 1 | 35 | 2.5 | 0.4 | Coating solution A3 | 0.7 | 0.8 |
| Ex. 4 | Carrier A4 | Magnetic particles 1 | 35 | 2.5 | 0.4 | Coating solution A4 | 0.7 | 0.8 |
| Ex. 5 | Carrier A5 | Magnetic particles 1 | 35 | 2.5 | 0.4 | Coating solution A5 | 1.0 | 1.2 |
| Com. Ex. 1 | Carrier A6 | Magnetic particles 1 | 35 | 2.5 | 0.4 | Comparative coating solution A6 | 1.2 | 1.5 |
| Com. Ex. 2 | Carrier A7 | Magnetic particles 1 | 35 | 2.5 | 0.4 | Comparative coating solution A7 | 1.8 | 2.1 |
| Ex. 6 | Carrier A8 | Magnetic particles 2 | 35 | 1.0 | 0.5 | Coating solution A1 | 0.8 | 1.1 |
| Ex. 7 | Carrier A9 | Magnetic particles 3 | 35 | 3.5 | 0.6 | Coating solution A1 | 0.6 | 0.9 |
| Ex. 8 | Carrier A10 | Magnetic particles 4 | 35 | 2.5 | 0.2 | Coating solution A1 | 0.6 | 1.0 |
| Ex. 9 | Carrier A11 | Magnetic particles 5 | 35 | 2.5 | 0.7 | Coating solution A1 | 0.5 | 0.8 |
| Ex. 10 | Carrier A12 | Magnetic particles 6 | 35 | 0.8 | 0.4 | Coating solution A1 | 0.7 | 1.1 |
| Ex. 11 | Carrier A13 | Magnetic particles 7 | 35 | 3.8 | 0.6 | Coating solution A1 | 0.7 | 1.0 |
| Ex. 12 | Carrier A14 | Magnetic particles 8 | 35 | 2.3 | 0.1 | Coating solution A1 | 0.6 | 1.1 |
| Ex. 13 | Carrier A15 | Magnetic particles 9 | 35 | 2.7 | 0.8 | Coating solution A1 | 0.6 | 0.9 |
| Com. Ex. 3 | Carrier A16 | Magnetic particles 1 | 35 | 2.5 | 0.4 | Comparative coating solution A8 | 2.0 | 2.1 |
| Ex. 14 | Carrier A17 | Magnetic particles 1 | 35 | 2.5 | 0.4 | Coating solution A9 | 0.5 | 0.6 |

TABLE 2

| | | Magnetic particles | | | | | Color difference (ΔE) |
|---|---|---|---|---|---|---|---|
| | Carrier Type | Type | D50v (μm) | Sm | Ra | Coating solution Type | between C5 image and C6 image |
| Com. Ex. 1 | Carrier B1 | Magnetic particles 1 | 35 | 2.5 | 0.4 | Comparative coating solution B1 | 1.1 |
| Ex. 1 | Carrier B2 | Magnetic particles 1 | 35 | 2.5 | 0.4 | Coating solution B2 | 0.6 |
| Ex. 2 | Carrier B3 | Magnetic particles 1 | 35 | 2.5 | 0.4 | Coating solution B3 | 0.7 |
| Com. Ex. 2 | Carrier B4 | Magnetic particles 1 | 35 | 2.5 | 0.4 | Comparative coating solution B4 | 1.1 |
| Com. Ex. 3 | Carrier B5 | Magnetic particles 1 | 35 | 2.5 | 0.4 | Comparative coating solution B5 | 1.2 |
| Com. Ex. 4 | Carrier B6 | Magnetic particles 1 | 35 | 2.5 | 0.4 | Comparative coating solution B6 | 1.1 |
| Com. Ex. 5 | Carrier B7 | Magnetic particles 1 | 35 | 2.5 | 0.4 | Comparative coating solution B7 | 1.8 |
| Ex. 3 | Carrier B8 | Magnetic particles 2 | 35 | 1.0 | 0.5 | Coating solution B1 | 0.8 |
| Ex. 4 | Carrier B9 | Magnetic particles 3 | 35 | 3.5 | 0.6 | Coating solution B1 | 1.0 |
| Ex. 5 | Carrier B10 | Magnetic particles 4 | 35 | 2.5 | 0.2 | Coating solution B1 | 0.9 |
| Ex. 6 | Carrier B11 | Magnetic particles 5 | 35 | 2.5 | 0.7 | Coating solution B1 | 0.8 |
| Ex. 7 | Carrier B12 | Magnetic particles 6 | 35 | 0.8 | 0.4 | Coating solution B1 | 0.7 |
| Ex. 8 | Carrier B13 | Magnetic particles 7 | 35 | 3.8 | 0.6 | Coating solution B1 | 0.8 |
| Ex. 9 | Carrier B14 | Magnetic particles 8 | 35 | 2.3 | 0.1 | Coating solution B1 | 0.8 |
| Ex. 10 | Carrier B15 | Magnetic particles 9 | 35 | 2.7 | 0.8 | Coating solution B1 | 0.9 |
| Com. Ex. 6 | Carrier B16 | Magnetic particles 1 | 35 | 2.5 | 0.4 | Comparative coating solution B8 | 2.0 |
| Com. Ex. 7 | Carrier B17 | Magnetic particles 1 | 35 | 2.5 | 0.4 | Comparative coating solution B9 | 1.6 |

From the results, it is found that, in the examples, the fluctuation in the image density is prevented due to a small color difference between the image printed in the environment of a temperature of 30° C. and humidity of 88% RH (high-temperature high-humidity environment) and in the environment of a temperature of 30° C. and humidity of 15% RH (high-temperature low-humidity environment), compared to the cases of comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

magnetic particles; and a resin coating layer that is coated on surfaces of the magnetic particles and comprises a copolymer comprisring:

a structural unit represented by the following Formula (NA):

(NA)

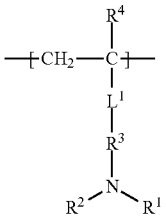

wherein $R^1$ and $R^2$ each independently represents a hydrogen atom or an alkyl group having 1 to 4 carbon atoms, provided that at least one of $R^1$ and $R^2$ represents an alkyl group having 1 to 4 carbon atoms, $R^1$ and $R^2$ do not represent a methyl group at the same time, and $R^1$ and $R^2$ do not represent an ethyl group at the same time; $R^3$ represents an alkylene group having 1 to 3 carbon atoms; $R^4$ represents a hydrogen atom or a methyl group; and $L^1$ represents —C(═O)—O—or —C═(O)—NH—, and a structural unit that comprises a cycloalkyl group.

wherein a content (polymerization ratio) of the structural unit comprising a cycloalkyl group is from 90% by weight to 99.5% by weight with respect to the coating resin.

2. The electrostatic charge image developing carrier according to claim 1, wherein a ruggedness average spacing Sm of surfaces of the magnetic particles is a value satisfying a relationship of 1.0μm≤Sm ≤3.5μm, and an arithmetic surface roughness Ra of the surfaces of the magnetic particles is a value satisfying a relationship of 0.2μm≤Ra ≤0.7μm.

3. The electrostatic charge image developing carrier according to claim 1, wherein a volume average particle diameter of the magnetic particles is from 25μm to 60μm.

4. The electrostatic charge image developing carrier according to claim 1, wherein a content (polymerization ratio) of the structural unit represented by Formula (NA) of the coating resin is from 0.1% by weight to 10% by weight with respect to the coating resin.

5. The electrostatic charge image developing carrier according to claim 1, wherein a weight average molecular weight Mw of the coating resin is from 3,000 to 200,000.

6. The electrostatic charge image developing carrier according to claim 1, wherein a weight average molecular weight Mw of the copolymer is from 3,000 to 200,000.

7. The electrostatic charge image developing carrier according to claim 1, wherein a coating amount of the coating resin layer is from 1.0% by weight to 5.0% by weight with respect to the magnetic particles.

8. An electrostatic charge image developer comprising:

an electrostatic charge image developing toner; and the electrostatic charge image developing carrier according to claim 1.

9. A developer cartridge, comprising:

a container that comprises the electrostatic charge image developer according to claim 8, wherein the developer cartridge is detachable from an image forming apparatus.

* * * * *